US008836618B2

(12) United States Patent
Liu et al.

(10) Patent No.: US 8,836,618 B2
(45) Date of Patent: Sep. 16, 2014

(54) PIXEL CIRCUIT, LIGHT EMITTING DIODE DISPLAY USING THE SAME AND DRIVING METHOD THEREOF

(71) Applicant: AU Optronics Corp., Hsin-Chu (TW)

(72) Inventors: Chun-Yen Liu, Hsin-Chu (TW); Chin-Sheng Yang, Hsin-Chu (TW); Guan-Ru Huang, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 100 days.

(21) Appl. No.: 13/752,473

(22) Filed: Jan. 29, 2013

(65) Prior Publication Data

US 2013/0314305 A1 Nov. 28, 2013

(30) Foreign Application Priority Data

May 24, 2012 (TW) ..... 101118561 A

(51) Int. Cl.
*G09G 3/32* (2006.01)

(52) U.S. Cl.
CPC ..... *G09G 3/32* (2013.01); *G09G 2300/0852* (2013.01); *G09G 2300/0861* (2013.01); *G09G 3/3208* (2013.01); *G09G 3/3233* (2013.01)
USPC ..... 345/77; 345/214

(58) Field of Classification Search
CPC ..... G09G 3/30; G09G 3/32; G09G 3/36; G09G 3/3208; G09G 5/00
USPC ..... 345/76–83, 211, 214; 315/169.3
See application file for complete search history.

(56) References Cited

U.S. PATENT DOCUMENTS

| | | | | |
|---|---|---|---|---|
| 7,982,699 | B2 * | 7/2011 | Chung | 345/82 |
| 8,044,908 | B2 * | 10/2011 | Lee | 345/94 |
| 8,077,126 | B2 * | 12/2011 | Lee et al. | 345/77 |
| 2011/0141000 | A1 | 6/2011 | Han et al. | |
| 2011/0267319 | A1 * | 11/2011 | Han | 345/204 |
| 2012/0013597 | A1 | 1/2012 | Han et al. | |
| 2012/0019501 | A1 * | 1/2012 | Choi | 345/211 |

FOREIGN PATENT DOCUMENTS

CN 102339586 A 2/2012

OTHER PUBLICATIONS

China Patent Office, "Office Action", Mar. 21, 2014.

* cited by examiner

*Primary Examiner* — Andrew Sasinowski
(74) *Attorney, Agent, or Firm* — WPAT, PC; Justin King

(57) ABSTRACT

A pixel circuit of a light emitting diode display includes a light emitting diode, six transistors and two capacitors. The effect of the variation of the threshold voltage of the transistor in the pixel circuit on the display quality can be improved through supplying specific the first to fourth control signals and the first to third reference voltages to the pixel circuit. A light emitting diode display using the aforementioned pixel circuit and a driving method of the aforementioned pixel circuit are also provided.

14 Claims, 6 Drawing Sheets

PIXEL CIRCUIT, LIGHT EMITTING DIODE DISPLAY USING THE SAME AND DRIVING METHOD THEREOF

TECHNICAL FIELD

The disclosure relates to a pixel circuit, a display using the same and a driving method thereof, and more particularly to a pixel circuit, a light emitting diode (LED) display using the same and a driving method thereof.

BACKGROUND

In recent years, organic LED display becomes more and more popular due to with self-luminous, fast response time and low power consumption features. However, the driving transistors, arranged in the driving circuit of the organic LED display, may have threshold voltage variations and thereby affecting the current for driving the organic LEDs or even leading the uneven brightness on the organic LEDs if the threshold voltage variations are serious.

In addition, with the development of the display technology, today's display consumes less power, has higher resolution and smaller size. However, the number of the scan signal lines of scan driver increases as well as the scan time of the scan driver decreases with increasing resolutions. Thus, it is important to those ordinarily skilled in the art to solve the threshold voltage variation problem and develop a pixel circuit capable of completing the compensation operations of the organic LED driving circuit in the limited scan time.

SUMMARY OF EMBODIMENTS

Therefore, one object of the present disclosure is to provide a pixel circuit, an LED display using the same and a driving method thereof capable fixing the uneven brightness issue caused by transistor's threshold voltage variation and further completing a compensation operation of the organic LED driving circuit in a limited scan time.

An embodiment of the present disclosure provides a pixel circuit of a light emitting diode display, which includes a first transistor, a first capacitor, a second transistor, a third transistor, a fourth transistor, a fifth transistor, a second capacitor, a sixth transistor and a light emitting diode. The first transistor has a first terminal, a control terminal and a second terminal. The first terminal of the first transistor is configured to receive a data signal; the control terminal of the first transistor is a configured to receive a first control signal. The first capacitor has a first terminal and a second terminal. The first terminal of the first capacitor is electrically connected to the second terminal of the first transistor; the second terminal of the first capacitor is electrically connected to a connecting node. The second transistor has a first terminal, a control terminal and a second terminal. The first terminal of the second transistor is configured to receive a first reference voltage; the control terminal of the second transistor is electrically connected to the connecting node. The third transistor has a first terminal, a control terminal and a second terminal. The first terminal of the third transistor is electrically connected to the connecting node; the control terminal of the third transistor is configured to receive a second control signal; the second terminal of the third transistor is electrically connected to the second terminal of the second transistor. The fourth transistor has a first terminal, a control terminal and a second terminal. The first terminal of the fourth transistor is electrically connected to the connecting node; the control terminal of the fourth transistor is configured to receive a third control signal; the second terminal of the fourth transistor is configured to receive a second reference voltage. The fifth transistor has a first terminal, a control terminal and a second terminal. The first terminal of the fifth transistor is electrically connected to the first terminal of the second transistor; the control terminal of the fifth transistor is configured to receive the second control signal; the second terminal of the fifth transistor is electrically connected to the first terminal of the first capacitor. The second capacitor has a first terminal and a second terminal. The first terminal of the second capacitor is electrically connected to the first terminal of the fifth transistor; the second terminal of the second capacitor is electrically connected to the connecting node. The sixth transistor has a first terminal, a control terminal and a second terminal. The first terminal of the sixth transistor is electrically connected to the second terminal of the second transistor; the control terminal of the sixth transistor is configured to receive a fourth control signal. The light emitting diode has a first terminal and a second terminal. The first terminal of the light emitting diode is electrically connected to the second terminal of the sixth transistor; the second terminal of the light emitting diode is configured to receive a third reference voltage.

Another embodiment of the present disclosure provides a light emitting diode display, which includes a power supply unit, a scan driver, a data driver, a timing controller and a plurality of pixel circuits. The power supply unit is configured to provide a first reference voltage, a second reference voltage and a third reference voltage through a first power line, a second power line and a third power line, respectively. The scan driver is configured to provide a first control signal, a second control signal, a third control signal and a fourth control signal through a first control signal line, a second control signal line, a third control signal line and a fourth control signal line, respectively. The data driver is configured to provide a data signal through a data signal line. The timing controller is electrically connected to the scan driver and the data driver and configured to control the scan driver and the data drive. The pixel circuits are electrically connected to the power supply unit, the scan driver and the data driver. Each pixel circuit includes a first transistor, a first capacitor, a second transistor, a third transistor, a fourth transistor, a fifth transistor, a second capacitor, a sixth transistor and a light emitting diode. The first transistor has a first terminal, a control terminal and a second terminal. The first terminal of the first transistor is electrically connected to the data signal line; the control terminal of the first transistor is electrically connected to the first control signal line. The first capacitor has a first terminal and a second terminal. The first terminal of the first capacitor is electrically connected to the second terminal of the first transistor; the second terminal of the first capacitor is electrically connected to a connecting node. The second transistor has a first terminal, a control terminal and a second terminal. The first terminal of the second transistor is electrically connected to the first power line; the control terminal of the second transistor is electrically connected to the connecting node. The third transistor has a first terminal, a control terminal and a second terminal. The first terminal of the third transistor is electrically connected to the connecting node; the control terminal of the third transistor is electrically connected to the second control signal line; the second terminal of the third transistor is electrically connected to the second terminal of the second transistor. The fourth transistor has a first terminal, a control terminal and a second terminal. The first terminal of the fourth transistor is electrically connected to the connecting node; the control terminal of the fourth transistor is electrically connected to the third control signal line; the second terminal of the fourth transistor is electrically connected to the second power line. The fifth transistor has a first terminal, a control terminal and a second terminal. The first terminal of the fifth transistor is electrically connected to the first terminal of the second transistor; the control terminal of the fifth transistor is electrically connected to the second control signal line; the second terminal of the fifth transistor is electrically connected to the first terminal of the first capacitor. The second capacitor has a first terminal and a second terminal. The first terminal of the second capacitor is electrically connected to the first terminal of the fifth transistor; the second terminal of the second capacitor is electrically connected to the connecting node. The sixth transistor has a first terminal, a control terminal and a second terminal. The first terminal of the sixth transistor is electrically connected to the second terminal of the second transistor; the control terminal of the sixth transistor is electrically connected to the fourth control signal line. The light emitting diode has a first terminal and a second terminal. The first terminal of the light emitting diode is electrically connected to the second terminal of the sixth transistor; the second terminal of the light emitting diode is electrically connected to the third power line.

Still another embodiment of the present disclosure provides a driving method of a pixel circuit of a light emitting diode display. The pixel circuit includes a light emitting diode, a first transistor, a first capacitor, a second transistor, a third transistor, a fourth transistor, a fifth transistor, a second capacitor, a sixth transistor. The driving method includes: in a first time period, turning on the fourth transistor and thereby pulling the voltage level at a control terminal of the second transistor down to a second reference voltage; in a second time period following after the first time period, turning on the fifth transistor so as to transmit a first reference voltage to a first terminal of the second capacitor, turning on the third transistor so as to change the voltage level at the control terminal of the second transistor until the second transistor is turned off, and turning off the fourth transistor; in a third time period following after the second time period, turning on the first transistor and thereby transmitting a data signal to the first terminal of the second capacitor and setting, through the coupling of the second capacitor, the voltage level at the control terminal of the second transistor which is connected to the second terminal of the second capacitor; and in a fourth time period following after the third time period, turning on the sixth transistor so as to drive the current flowing through the second transistor and the sixth transistor to light up the light emitting diode.

In summary, the pixel circuit, the LED display using the same and the driving method thereof according to the present disclosure can fix the uneven brightness issue caused by transistor's threshold voltage variation. In addition, through configuring the associated control signals properly, the pixel circuit can have a proper circuit compensation time in a high-resolution environment, and consequently the LED display can have an improved display quality.

BRIEF DESCRIPTION OF THE DRAWINGS

The above embodiments will become more readily apparent to those ordinarily skilled in the art after reviewing the following detailed description and accompanying drawings, in which.

DETAILED DESCRIPTION OF EMBODIMENTS

The disclosure will now be described more specifically with reference to the following embodiments. It is to be noted that the following descriptions of preferred embodiments are presented herein for purpose of illustration and description only. It is not intended to be exhaustive or to be limited to the precise form disclosed.

Figure 1:
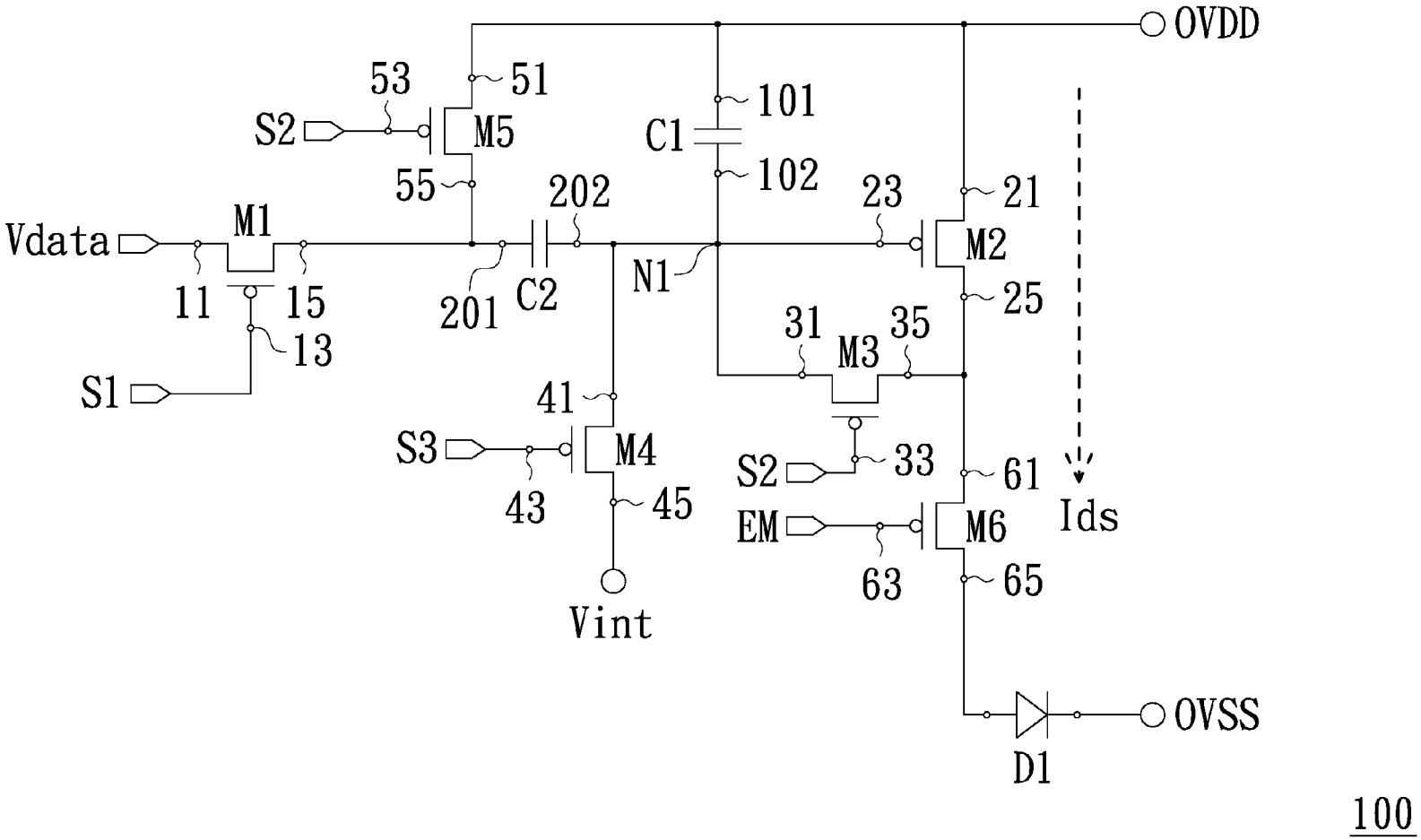
FIG. 1 is a schematic view of a pixel circuit of a light emitting diode display in accordance with an embodiment of the present disclosure.

FIG. 1 is a schematic view of a pixel circuit of a light emitting diode (LED) display in accordance with an embodiment of the present disclosure. As shown, the pixel circuit 100 of an LED display in this embodiment includes transistors M1, M2, M3, M4, M5, M6, capacitors C1, C2 and an LED D1. The transistors M1, M2, M3, M4, M5 and M6 each are, for example, constituted by a field-effect transistors or a bipolar transistor, and preferably is constituted by a P-type thin film transistor.

The transistor M1 has a first terminal 11, a control terminal 13 and a second terminal 15. The first terminal 11 of the transistor M1 is configured to receive a data signal Vdata. The control terminal 13 of the transistor M1 is a configured to receive a first control signal S1. The first terminal 11 of the transistor M1 is a source/drain terminal. The control terminal 13 of the transistor M1 is a gates terminal. The second terminal 15 of the transistor M1 is a drain/source terminal. Based on the same configuration, the first terminal of each of the transistors M2~M6 is a source/drain terminal; the control terminal of each of the transistors M2~M6 is a gates terminal; and accordingly the second terminal of each of the transistors M2~M6 is a drain/source terminal.

As depicted in FIG. 1, the capacitor C2 has a first terminal 201 and a second terminal 202. The first terminal 201 of the capacitor C2 is electrically connected to the second terminal 15 of the transistor M1. The second terminal 202 of the capacitor C2 is electrically connected to a connecting node N1. The transistor M2 has a first terminal 21, a control terminal 23 and a second terminal 25. The first terminal 21 of the transistor M2 is configured to receive a first reference voltage OVDD. The control terminal 23 of the transistor M2 is electrically connected to the connecting node N1. The transistor M3 has a first terminal 31, a control terminal 33 and a second terminal 35. The first terminal 31 of the transistor M3 is electrically connected to the connecting node N1. The control terminal 33 of the transistor M3 is configured to receive a second control signal S2. The second terminal 35 of the transistor M3 is electrically connected to the second terminal 25 of the transistor M2.

In addition, as depicted in FIG. 1, the transistor M4 has a first terminal 41, a control terminal 43 and a second terminal 45. The first terminal 41 of the transistor M4 is electrically connected to the connecting node N1. The control terminal 43 of the transistor M4 is configured to receive the third control signal S3. The second terminal 45 of the transistor M4 is configured to receive the second reference voltage Vint. The transistor M5 has a first terminal 51, a control terminal 53 and a second terminal 55. The first terminal 51 of the transistor M5 is electrically connected to the first terminal 21 of the transistor M2. The control terminal 53 of the transistor M5 is configured to receive the second control signal S2. The second terminal 55 of the transistor M5 is electrically connected to the first terminal 201 of the capacitor C2.

In addition, as depicted in FIG. 1, the capacitor C1 has a first terminal 101 and a second terminal 102. The first terminal 101 of the capacitor C1 is electrically connected to the first terminal 51 of the transistor M5. The second terminal 102 of the capacitor C1 is electrically connected to the connecting node N1. The capacitor C1 in this embodiment is, for example, a storage capacitor of the pixel circuit 100. The transistor M6 has a first terminal 61, a control terminal 63 and a second terminal 65. The first terminal 61 of the transistor M6 is electrically connected to the second terminal 25 of the transistor M2. The control terminal 63 of the transistor M6 is configured to receive the fourth control signal EM.

The LED D1 has a first terminal (not labeled) and a second terminal (not labeled). The first terminal of the LED D1 is electrically connected to the second terminal 65 of the transistor M6. The second terminal of the LED D1 is configured to receive the third reference voltage OVSS. In this embodiment, the first terminal of the LED D1 is, for example, an input terminal and the second terminal is an output terminal. Moreover, the LED D1 is, for example, an organic LED.

In this embodiment, the first reference voltage OVDD is configured to have a voltage level greater than that of the second reference voltage Vint; the second reference voltage Vint is configured to have a voltage level greater than that of the third reference voltage OVSS; and accordingly the first reference voltage OVDD is configured to have a voltage level greater than that of the third reference voltage OVSS. Specifically, the second reference voltage Vint basically has a voltage level less than 0. The first reference voltage OVDD, the second reference voltage Vint and the third reference voltage OVSS each can be provide by a DC voltage source (not shown).

Figure 2:
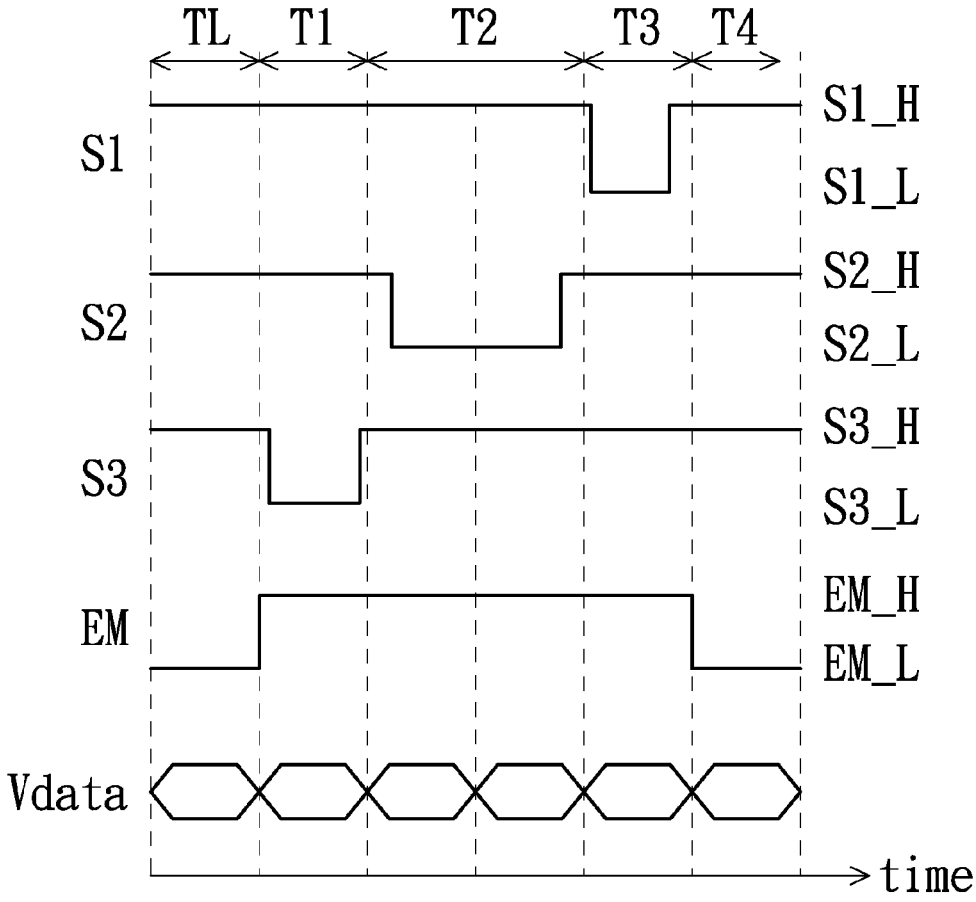
FIG. 2 is a schematic sequence view of the signals associated with the pixel circuit shown in FIG. 1.

FIG. 2 is a schematic sequence view of the signals associated with the pixel circuit 100 shown in FIG. 1; wherein the horizontal axis (or, x-axis) herein represents a time domain. As shown, the logic-high of the first control signal S1 is indicated by S1_H, and the logic-low of the first control signal S1 is indicated by S1_L; the logic-high of the second control signal S2 is indicated by S2_H, and the logic-low of the second control signal S2 is indicated by S2_L; the logic-high of the third control signal S3 is indicated by S3_H, and the logic-low of the third control signal S3 is indicated by S3_L; the logic-high of the fourth control signal EM is indicated by EM_H, and the logic-low of the fourth control signal EM is indicated by EM_L. The following description is the operation process of the pixel circuit 100 of an LED display in this embodiment.

Please refer to both FIGS. 1, 2. First, in the first time period T1, the pixel circuit 100 is operated in a power-discharge state and configured to perform a reset operation. Specifically, in the first time period T1 and herein the transistors M1~M6 each are exemplified by a P-type thin film transistor, the first terminal 11 of the transistor M1 is supplied with the data signal Vdata; the control terminal 13 of the transistor M1 is supplied with a logic-high first control signal S1; the control terminal 33 of the transistor M3 and the control terminal 53 of the transistor M5 each are supplied with a logic-high second control signal S2; the control terminal 43 of the transistor M4 is supplied with a logic-low third control signal S3; and the control terminal 63 of the transistor M6 is supplied with a logic-high fourth control signal EM. Thus, the transistors M1, M3, M5 and M6 are turned off and the transistors M2, M4 are turned on in the first time period T1; wherein the transistor M2 is turned on due to the mode N1 has a voltage level approximately equal to the voltage level of the logic-low second reference voltage Vint.

In addition, as illustrated in FIG. 2, the first control signal S1 is shaped to have a falling edge lagging behind a rising edge of the second control signal S2; the second control signal S2 is shaped to have a falling edge lagging behind a rising edge of the third control signal S3; and the third control signal S3 is shaped to have a falling edge lagging behind a rising edge of the fourth control signal EM. Thus, the control terminal 23 of the transistor M2 is pulled up to have a voltage level of the second reference voltage Vint; in other words, the voltage level at the connecting node N1 is equal to the second reference voltage Vint in the first time period T1.

Afterwards, in the second time period T2, the pixel circuit 100 is operated in a compensation state; wherein the configurations of the data signal Vdata and the control signals S1, S2, S3, and EM are illustrated in FIG. 2, and no unnecessary detail is given here. Specifically, the transistors M1, M4 and M6 are turned off and the transistors M2, M3 and M5 are turned on in the second time period T2. In addition, it is to be noted that the voltage level at the connecting node N1 is approximately equal to that at the second terminal 25 of the transistor M2 due to the two turned-on transistors M2, M3 corporately form a diode-connected transistor. Thus, the transistor M2 is operated in the turned-on state and will not be turned off until the control terminal 23 thereof has a voltage level reaching to OVDD−|Vth|; wherein Vth is the threshold voltage of the transistor M2. In other words, the transistor M2 will not be cut off until the control terminal 23 thereof has a voltage level of OVDD−|Vth|. Therefore, eventually the voltage level at the connecting node N1 is approximately equal to OVDD−|Vth| in the second time period T2.

In general, the second time period T2 is configured to be greater than 10 μs in a high-resolution display condition; therefore, the second time period T2 in this embodiment is configured to be about 30 μs in response to the aforementioned design requirement. In addition, as illustrated in FIG. 2, because the second control signal S2 in the second time period T2 is configured to have a relatively long pull-down duration and the first control signal S1 and the fourth control signal EM each have a delayed level switching, the present disclosure can have longer compensation time and enhanced compensation effect, and the compensation operation can be completed in the one-row scan time TL of a scan driver 440 (shown in FIG. 4).

Afterwards, in the third time period T3, the pixel circuit 100 is operated in a data writing state. Specifically, in the third time period T3, the transistors M3, M4, M5 and M6 are turned off and the transistors M1, M2 are turned on. Thus, the data signal Vdata is supplied into the capacitor C2 via the turned-on transistor M1 so as to convert the voltage level at the first terminal 201 of the capacitor C2 from first reference voltage OVDD to the voltage level of the data signal Vdata and convert the voltage level at the second terminal 202 of the capacitor C2 to Vdata−|Vth|; wherein Vth is the threshold voltage of the transistor M2 through the coupling relationship of the capacitor C2. Therefore, eventually the voltage level at the connecting node N1 is approximately equal to Vdata−|Vth| in the second time period T2.

Afterwards, in the third time period T4, the pixel circuit 100 is operated in an illumination state so as to light the LED D1 through the transistor M6. Specifically, in the fourth time period T4 as depicted in FIG. 1, the transistors M1, M3, M4 and M5 are turned off and the transistors M2, M6 are turned on.

In the fourth time period T4, the current Ids flowing through the transistor M2 is obtained according to the equation (1):

$$Ids=\frac{1}{2}\beta(Vsg-|Vth|)^2 \quad (1)$$

Vsg is the voltage difference between the first terminal 21 and the control terminal 23 of the transistor M2. The control terminal 23 of the transistor M2 has a voltage level of Vdata−|Vth|; wherein Vth is the threshold voltage of the transistor M2. The first terminal 21 of the transistor M2 has a voltage level of the first reference voltage OVDD. Thus, an equation (2) is derived from the equation (1):

$$Ids=\frac{1}{2}\beta(OVDD-(V\text{data}-|Vth|)-|Vth|)^2 \quad (2)$$

Finally, through the elimination of the threshold voltage Vth an equation (3) is obtained:

$$Ids=\frac{1}{2}\beta(OVDD-V\text{data})^2 \quad (3)$$

In summary, because the connecting node N1 within the fourth time period T4 has a voltage level of Vdata−|Vth|, which can eliminate the effect of the threshold voltage Vth of the transistor M2 on the current Ids flowing through the transistors M2, M6, the current Ids flowing through the transistors M2, M6 is relatively independent of the threshold voltage Vth of the transistor M2 and consequently the LED D1 has more even brightness.

Figure 3:
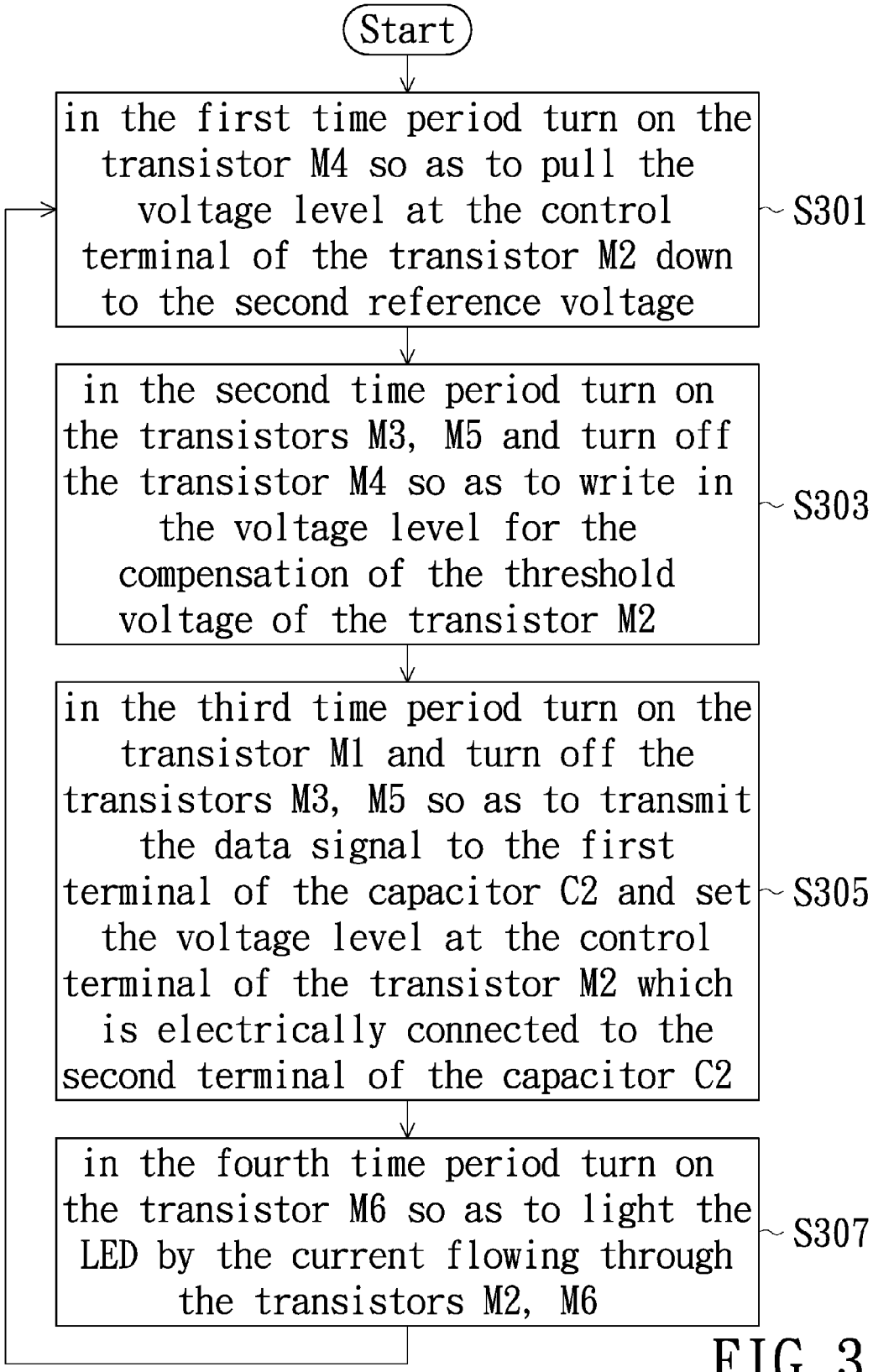
FIG. 3 is a schematic flow chart illustrating a driving method of a pixel circuit of an LED display in accordance with an embodiment of the present disclosure.

FIG. 3 is a schematic flow chart illustrating a driving method of a pixel circuit of an LED display in accordance with an embodiment of the present disclosure. Please refer to both FIGS. 1, 3. First, in the first time period as illustrated in step S301, the transistor M4 is turned on and thereby pulling the voltage level at the control terminal 23 of the second transistor M2 down to the second reference voltage Vint; accordingly, in the first time period the connecting mode N1 has a voltage level equal to the second reference voltage Vint.

Then, in the second time period which is following after the first time period as illustrated in step S303, the transistor M5 is turned on so as to transmit the first reference voltage OVDD to the first terminal 201 of the capacitor C2. Meanwhile, the transistor M3 is turned on so as to change the voltage level at the control terminal 23 of the transistor M2 until the transistor M2 is turned off, and the transistor M4 is turned on so as to supply the voltage level for compensating the threshold voltage of the transistor M2. In other words, in the second time period the connecting node N1 is configured to have a voltage level of OVDD−|Vth|; wherein Vth is the threshold voltage of the transistor M2.

Afterwards, in the third time period which is following after the second time period as illustrated in step S305, the transistors M1, M3 and M5 are turned on and thereby transmitting the data signal Vdata to the first terminal 201 of the capacitor C2 and setting, through the coupling of the capacitor C2, the voltage level at the control terminal 23 of the transistor M2 which is connected to the second terminal 202 of the capacitor C2. Therefore, the connecting node N1 has a voltage level of Vdata−|Vth|, and Vth is the threshold voltage of the transistor M2. In addition, the second time period is greater than at least 1.5 times of the third time period, and the transistors M3, M5 are turned off within the third time period.

Afterwards, in the fourth time period which is following after the third time period as illustrated in step S307, the transistor M6 is turned on so as to drive the current flowing through the transistors M2, M6 to light up the LED D1; wherein the voltage level at the connecting node N1 is Vdata−|Vth|, and Vth is the threshold voltage of the transistor M2.

Figure 4:
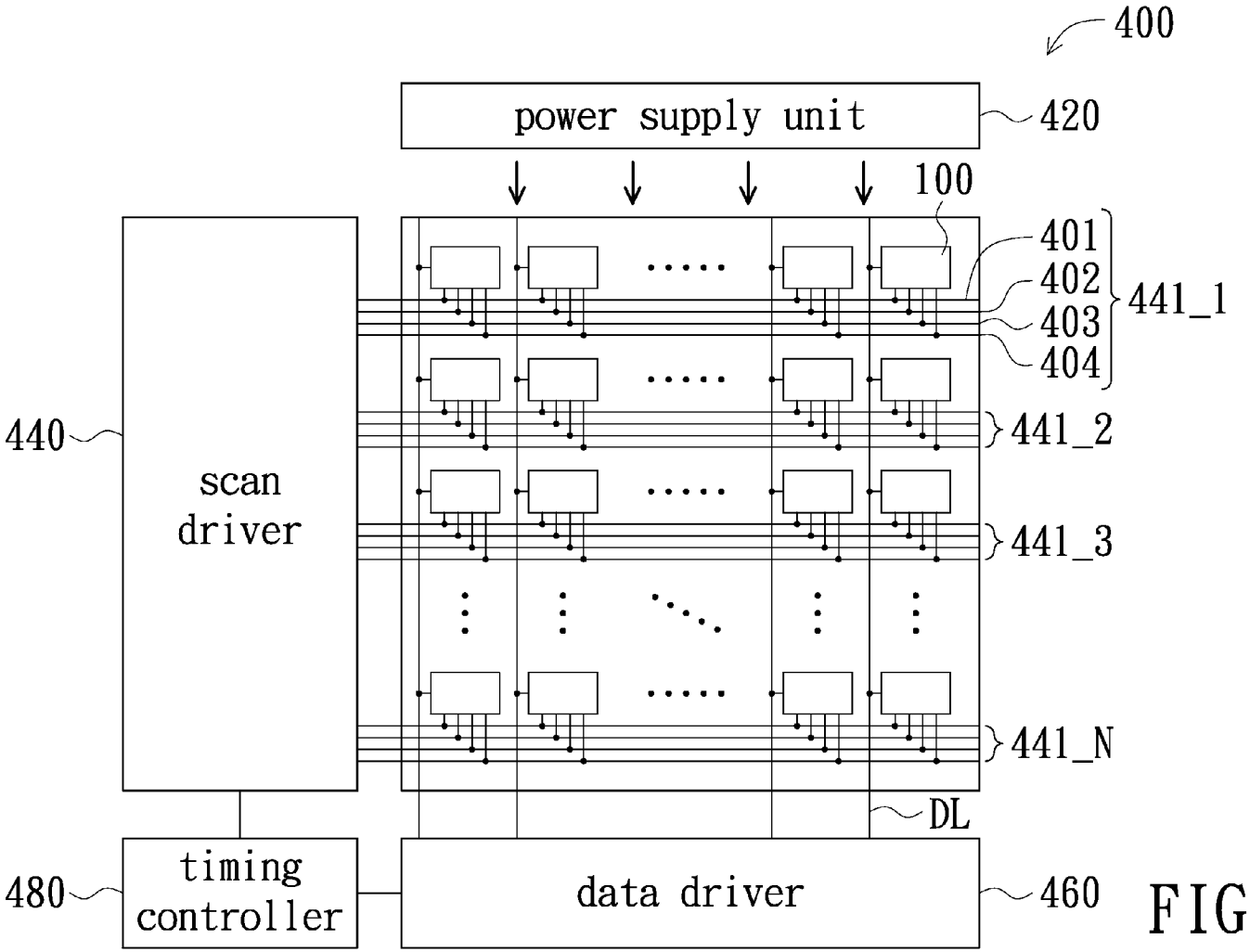
FIG. 4 is a schematic circuit view of an LED display in accordance with an embodiment of the present disclosure.

FIG. 4 is a schematic circuit view of an LED display in accordance with an embodiment of the present disclosure. Please refer to both FIGS. 1, 4. The LED display 400 in this embodiment includes a power supply unit 420, a scan driver 440, a data driver 460, a timing controller 480 and a plurality of pixel circuits 100.

The power supply unit 420 is configured to provide the first reference voltage OVDD, the second reference voltage Vint and the third reference voltage OVSS through respective power lines (not labeled). Basically, the first reference voltage OVDD is configured to have a voltage level greater than that of the second reference voltage Vint; the second reference voltage Vint is configured to have a voltage level greater than that of the third reference voltage OVSS; and the second reference voltage Vint has a voltage level less than 0. In addition, the power supply unit 420 is a DC power supply unit or other electronic circuit components capable of providing reference voltages.

The scan driver 440 is electrically connected to each pixel circuit 100 through a plurality of control signal lines (e.g., the first control signal line 401, the second control signal line 402, the third control signal line 403 and the fourth control signal line 404). Specifically, the scanner drive 440 is configured to provide the first control signal S1, the second control signal S2, the third control signal S3 and the fourth control signal EM to each pixel circuit 100 through the first control signal line 401, the second control signal line 402, the third control signal line 403 and the fourth control signal line 404, respectively.

The data driver 460 is electrically connected to columns of pixel circuit 100 through a plurality of data signal lines DL, respectively. Specifically, the data driver 460 is configured to supply the data signal Vdata to each pixel circuit 100 through the data signal lines DL.

The timing controller 480 is electrically connected to the scan driver 440 and the data driver 460. Specifically, the timing controller 480 is configured to control the scan driver 440 to provide the first control signal S1, the second control signal S2, the third control signal S3 and the fourth control signal EM and control the data driver 460 to provide the data signal Vdata.

The pixel circuits 100 are electrically connected to the power supply unit 420, the scan driver 440 and the data driver 460. The circuit structure of the pixel circuit 100 has been described in FIG. 1, and no unnecessary detail is given here. In addition, it is to be noted that the transistors M1~M6 in the pixel circuit 100 are electrically connected to the power supply unit 420, the scan driver 440 and the data driver 460 through the power lines, the first control signal line 401, the second control signal line 402, the third control signal line 403, the fourth control signal line 404 and the data signal line DL so as to receive the first reference voltage OVDD, the second reference voltage Vint, the third reference voltage OVSS, the first control signal S1, the second control signal S2, the third control signal S3, the fourth control signal EM and the data signal Vdata, respectively.

Figure 5:
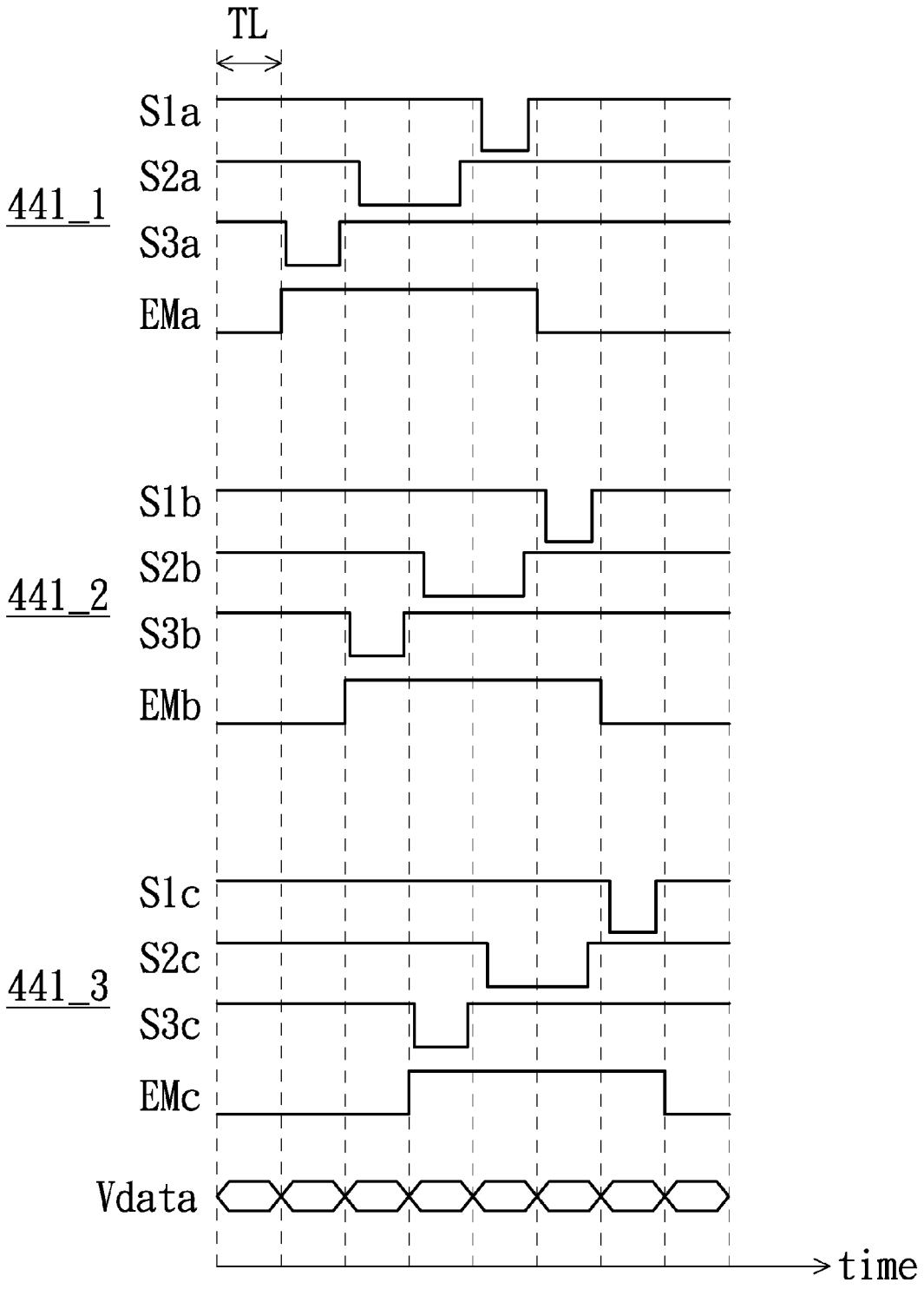
FIG. 5 is a schematic sequence view of the signals associated with the LED display shown in FIG. 4.

FIG. 5 is a schematic sequence view of the signals associated with the LED display 400 shown in FIG. 4; wherein the horizontal axis (or, x-axis) herein represents a time domain. Please refer to FIGS. 2, 4 and 5. The first-row scan signal line 441-1 is configured to transmit the control signals (that is, the control signals S1*a*, S2*a*, S3*a* and EMa) through the first control signal line 401, the second control signal line 402, the third control signal line 403 and the fourth control signal line 404, respectively. According to the same manner, the second-row scan signal line 441-2, the third-row scan signal line 441-3, . . . , and the Nth-row scan signal line 441-N each are configured to transmit the associated control signals through the respective first control signal line 401, the second control signal line 402, the third control signal line 403 and the fourth control signal line 404, respectively. Specifically, the control signals S1*a*, S2*a*, S3*a* and EMa associated with the first-row scan signal line 441-1 are configured to have a sequence prior to that of the control signals S1*b*, S2*b*, S3*b* and EMb associated with the second-row scan signal line 441-2, respectively; and the control signals S1*b*, S2*b*, S3*b* and EMb associated with the second-row scan signal line 441-2 are configured to have a sequence prior to that of the control signals S1*c*, S2*c*, S3*c* and EMc associated with the third-row scan signal line 441-3, respectively. In addition, the second time period T2 is configured to be greater than the one-row scan time of the scan driver 440.

Figure 6:
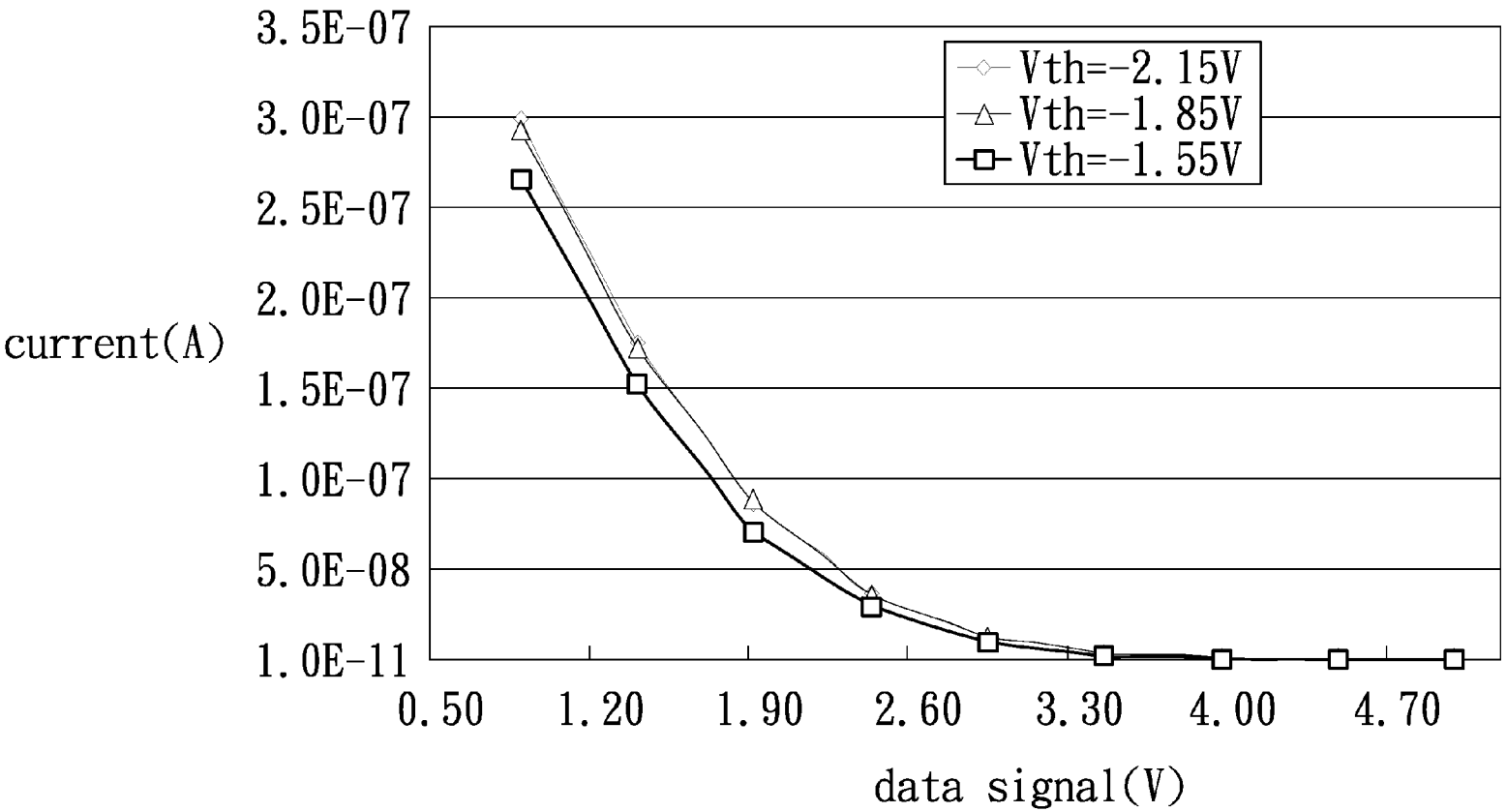
FIG. 6 is a schematic view illustrating the relationship curves between the data signal and the current derived from the embodiment of the present disclosure.

Please refer to both FIGS. 1, 6. FIG. 6 is a schematic view illustrating the relationship curves between the data signal and the current derived from the embodiment of the present disclosure; wherein the horizontal axis (or, x-axis) herein represents the intensity of the data signal Vdata (V), and the vertical axis (or, y-axis) herein represents the intensity of the current Ids (A) flowing through the transistors M2, M6. As shown in FIG. 6, the current Ids has a variation ratio about 1.58% if the threshold voltage Vth of the transistor M2 is changed from −2.15V to −1.85V, and has a variation ratio about 11.04% if the threshold voltage Vth is changed from −2.15V to −1.55V. Compared with the current Ids, derived from the conventional pixel circuit without any compensation circuit structure, having a variation ratio of 60% if the threshold voltage Vth of the associated transistor is changed from −0.9V to −1.5V, the present disclosure has a better compensation effect.

In summary, the pixel circuit, the LED display using the same and the driving method thereof according to the present disclosure can fix the uneven brightness issue caused by transistor's threshold voltage variation. In addition, through configuring the associated control signals properly, the pixel circuit can have a proper circuit compensation time in a high-resolution environment, and consequently the LED display can have an improved display quality.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A pixel circuit of a light emitting diode display, comprising:

a first transistor having a first terminal, a control terminal and a second terminal, wherein the first terminal of the first transistor is configured to receive a data signal, the control terminal of the first transistor is a configured to receive a first control signal;

a first capacitor having a first terminal and a second terminal, wherein the first terminal of the first capacitor is electrically connected to the second terminal of the first transistor, the second terminal of the first capacitor is electrically connected to a connecting node;

a second transistor having a first terminal, a control terminal and a second terminal, wherein the first terminal of the second transistor is configured to receive a first reference voltage, the control terminal of the second transistor is electrically connected to the connecting node;

a third transistor having a first terminal, a control terminal and a second terminal, wherein the first terminal of the third transistor is electrically connected to the connecting node, the control terminal of the third transistor is configured to receive a second control signal, the second terminal of the third transistor is electrically connected to the second terminal of the second transistor;

a fourth transistor having a first terminal, a control terminal and a second terminal, wherein the first terminal of the fourth transistor is electrically connected to the connecting node, the control terminal of the fourth transistor is configured to receive a third control signal, the second terminal of the fourth transistor is configured to receive a second reference voltage;

a fifth transistor having a first terminal, a control terminal and a second terminal, wherein the first terminal of the fifth transistor is electrically connected to the first terminal of the second transistor, the control terminal of the fifth transistor is configured to receive the second control signal, the second terminal of the fifth transistor is electrically connected to the first terminal of the first capacitor;

a second capacitor having a first terminal and a second terminal, wherein he first terminal of the second capacitor is electrically connected to the first terminal of the fifth transistor, the second terminal of the second capacitor is electrically connected to the connecting node;

a sixth transistor having a first terminal, a control terminal and a second terminal, wherein the first terminal of the sixth transistor is electrically connected to the second terminal of the second transistor, the control terminal of the sixth transistor is configured to receive a fourth control signal; and a light emitting diode having a first terminal and a second terminal, wherein the first terminal of the light emitting diode is electrically connected to the second terminal of the sixth transistor, the second terminal of the light emitting diode is configured to receive a third reference voltage.

2. The pixel circuit of a light emitting diode display according to claim 1, wherein these transistors each are a P-type thin film transistor.

3. The pixel circuit of a light emitting diode display according to claim 1, wherein the light emitting diode is an organic light emitting diode.

4. The pixel circuit of a light emitting diode display according to claim 1, wherein the first reference voltage is configured to have a voltage level greater than that of the second reference voltage, the second reference voltage is configured to have a voltage level greater than that of the third reference voltage, and the second reference voltage has a voltage level less than 0.

5. A light emitting diode display, comprising:

a power supply unit configured to provide a first reference voltage, a second reference voltage and a third reference voltage through a first power line, a second power line and a third power line, respectively;

a scan driver configured to provide a first control signal, a second control signal, a third control signal and a fourth control signal through a first control signal line, a second control signal line, a third control signal line and a fourth control signal line, respectively;

a data driver configured to provide a data signal through a data signal line;

a timing controller, electrically connected to the scan driver and the data driver, configured to control the scan driver and the data drive; and a plurality of pixel circuits electrically connected to the power supply unit, the scan driver and the data driver, each pixel circuit comprising:

a first transistor having a first terminal, a control terminal and a second terminal, wherein the first terminal of the first transistor is electrically connected to the data signal line, the control terminal of the first transistor is electrically connected to the first control signal line;

a first capacitor having a first terminal and a second terminal, wherein the first terminal of the first capacitor is electrically connected to the second terminal of the first transistor, the second terminal of the first capacitor is electrically connected to a connecting node;

a second transistor having a first terminal, a control terminal and a second terminal, wherein the first terminal of the second transistor is electrically connected to the first power line, the control terminal of the second transistor is electrically connected to the connecting node;

a third transistor having a first terminal, a control terminal and a second terminal, wherein the first terminal of the third transistor is electrically connected to the connecting node, the control terminal of the third transistor is electrically connected to the second control signal line, the second terminal of the third transistor is electrically connected to the second terminal of the second transistor;

a fourth transistor having a first terminal, a control terminal and a second terminal, wherein the first terminal of the fourth transistor is electrically connected to the connecting node, the control terminal of the fourth transistor is electrically connected to the third control signal line, the second terminal of the fourth transistor is electrically connected to the second power line;

a fifth transistor having a first terminal, a control terminal and a second terminal, wherein the first terminal of the fifth transistor is electrically connected to the first terminal of the second transistor, the control terminal of the fifth transistor is electrically connected to the second control signal line, the second terminal of the fifth transistor is electrically connected to the first terminal of the first capacitor;

a second capacitor having a first terminal and a second terminal, wherein the first terminal of the second capacitor is electrically connected to the first terminal of the fifth transistor, the second terminal of the second capacitor is electrically connected to the connecting node;

a sixth transistor having a first terminal, a control terminal and a second terminal, wherein the first terminal of the sixth transistor is electrically connected to the second terminal of the second transistor, the control terminal of the sixth transistor is electrically connected to the fourth control signal line; and a light emitting diode having a first terminal and a second terminal, wherein the first terminal of the light emitting diode is electrically connected to the second terminal of the sixth transistor, the second terminal of the light emitting diode is electrically connected to the third power line.

6. The light emitting diode display according to claim 5, wherein these transistors each are a P-type thin film transistor.

7. The light emitting diode display according to claim 5, wherein the light emitting diode is an organic light emitting diode.

8. A driving method of a pixel circuit of a light emitting diode display, the pixel circuit comprising a light emitting diode, a first transistor, a first capacitor, a second transistor, a third transistor, a fourth transistor, a fifth transistor, a second capacitor, a sixth transistor, the driving method comprising:

in a first time period, turning on the fourth transistor and thereby pulling the voltage level at a control terminal of the second transistor down to a second reference voltage;

in a second time period following after the first time period, turning on the fifth transistor so as to transmit a first reference voltage to a first terminal of the second capacitor, turning on the third transistor so as to change the voltage level at the control terminal of the second transistor until the second transistor is turned off, and turning off the fourth transistor;

in a third time period following after the second time period, turning on the first transistor and thereby transmitting a data signal to the first terminal of the second capacitor and setting, through the coupling of the second capacitor, the voltage level at the control terminal of the second transistor which is connected to the second terminal of the second capacitor; and in a fourth time period following after the third time period, turning on the sixth transistor so as to drive the current flowing through the second transistor and the sixth transistor to light up the light emitting diode.

9. The driving method according to claim 8, wherein the first, third, fifth and sixth transistors are turned off and the fourth transistor is turned on in the first time period.

10. The driving method according to claim 9, wherein the first, fourth and sixth transistors are turned off and the third and fifth transistors are turned on in the second time period.

11. The driving method according to claim 10, wherein the third, fourth, fifth and sixth transistors are turned off in the third time period.

12. The driving method according to claim 11, wherein the first, third, fourth and fifth transistors are turned off in the fourth time period.

13. The driving method according to claim 12, wherein the second time period is greater than at least 1.5 times of the third time period.

14. The driving method according to claim 8, wherein the second time period is greater than at least 1.5 times of the third time period.

* * * * *